United States Patent [19]

Chen

[11] Patent Number: 4,785,289

[45] Date of Patent: Nov. 15, 1988

[54] TIMER CONTROLLED FIRE AND BURGLAR ALARM SYSTEM

[76] Inventor: Jack Y. C. Chen, 841 Chung Shan N. Rd., Sec. 5, Taipei, Taiwan

[21] Appl. No.: 37,781

[22] Filed: Apr. 13, 1987

[51] Int. Cl.[4] ..... B08B 1/00

[52] U.S. Cl. ..... 340/527; 340/309.15

[58] Field of Search ..... 340/527, 528, 565–567, 340/529, 530, 309.15

[56] References Cited

U.S. PATENT DOCUMENTS 4,064,507 12/1977 Schmitz ..... 340/539

*Primary Examiner*—Donnie L. Crosland

*Attorney, Agent, or Firm*—Wenderoth, Lind & Ponack

[57] ABSTRACT

A timer controlled fire and burglar alarm system using an economical circuit design and battery for prolonged and effective functioning and includes a thermo-electric infrared sensor, a filter and an amplifier to detect signal, a plurality of time priority circuits, a time-delay circuit, a timer controlled alarm setting circuit and timers with time display for setting and disarming of an alert condition and/or driving peripheral devices so as to function as a fire alarm, a burglar alarm and a visitor detection system.

1 Claim, 1 Drawing Sheet

TIMER CONTROLLED FIRE AND BURGLAR ALARM SYSTEM

BACKGROUND OF THE INVENTION

The present invention relates to a timer controlled fire and burglar alarm system, particularly a fire and burglar alarm system including timers and an ordinary battery used as a power source to function as fire alarm, burglar alarm, visitor detector and timer system by setting of function selector switches and to control an alarm system with timers.

Generally burglar alarm systems are mostly triggered by (1) direct contact or damage or (2) a detector. For the first method, a burgler may avoid contact and damage easily, and an alarm is triggered only after the occurrence of damage. As for the second method, a detector ususally is either on or off, it is unable to distinguish the identity of an invader and thus, an alarm may be triggered wrongly in certain circumstances, such as someone entering the detection zone without turning off the system.

Furthermore, most burglar systems available in the market use alternating current as a power source, and do not function during power failure or after the cutting off of the power source. Moreover, since an external power source is required, there is limit on the location of the installation and an experienced burglar can evade or damage it easily.

SUMMARY OF THE INVENTION

The main objective of the present invention is to provide a practical and versatile alarm system including timers and a time display for setting and disarming of an alert condition at a present time to meet individual requirements and to avoid an improper alarm.

Another objective of the present invention is to incorporate a burglar alarm with a fire alarm system by using a sensor which can detect infrared rays from a sudden change of room temperature, and to control other externally connected home appliances such as an audio-video system, an electric fan, an electric cooker, an electric heater, etc. by means of a timer.

Another objective of the present invention is to provide a time priority circuit and a time-delay circuit to control the signal detection system by a timer so that the generation of music is prior to an alarm, and the detection function can be inhibited temporarily to avoid an improper alarm.

Another objective of the present invention is to provide an alarm system with an ordinary battery used as the power source so that it can be installed at any location so as to prevent evasion or damage.

DESCRIPTION OF THE PREFERRED EMBODIMENT

Figure 1:
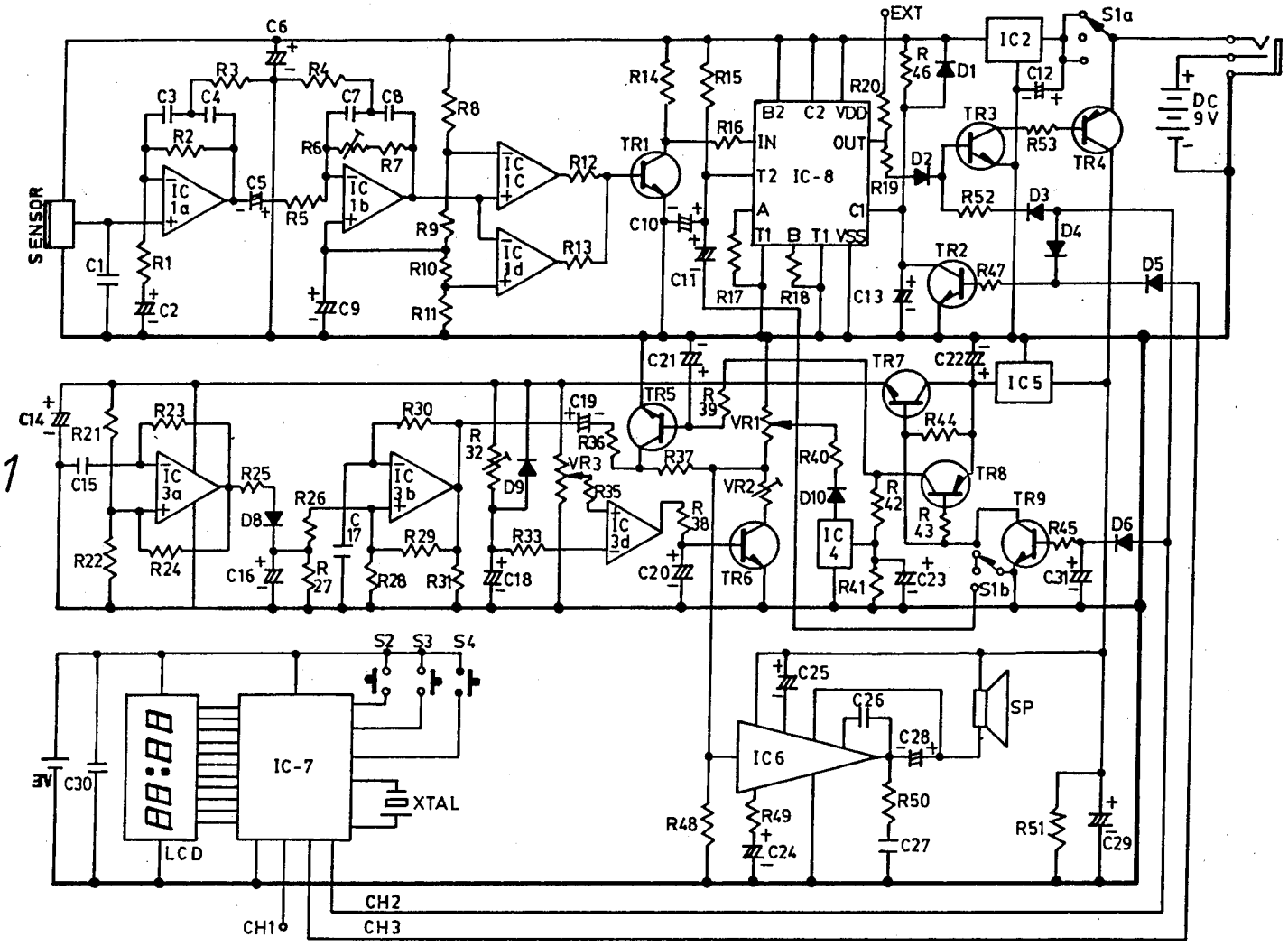
FIG. 1 is a circuit diagram for a preferred embodiment according to the present invention.

The clock controlled fire and burglar alarm system according to the present invention has a drive control which is mainly composed of a function selector switch S1 used to set the driving mode, and uses a thermo-electric infrared sensor to provide a driving signal. The control sequence and circuit of a preferred embodiment are described below with reference to the attached drawing.

(A) Signal Sensor and Detection

The present invention uses a thermo-electric infrared sensor to detect the invasion of a person into, or fire at its scope of detection by infrared rays from a human body or infrared rays from a sudden rising of room temperature which is converged to the sensor by means of reflector or converging lens. The sensor then transforms the change of infrared energy to a change of electrical potential, which is sent to the positive terminal of IC1*a* for amplification and filtering, and to C1 for filtering out of noise. IC1*a*, resistors R1, R2 and R3, and capacitors C2, C3 and C4 compose a non-inverting A.C. amplifier used to cut off unnecessary frequencies but to amplify the required frequency. The amplified signal is then sent to the negative terminal of IC1*b* via C5 and R5 for amplification and filtering. IC1*b*, resistors R5, R6. R7 and R4, and capacitors C5, C7 and C8 compose an inverting A.C. amplifier used to cut off unnecessary frequencies but to amplify the required frequency. R6 is a semi-variable resistor used to adjust amplification factor of IC1*b*. The amplified and filtered signal from IC1*b* is sent to an amplitude limited comparator composed of IC1*c*, IC1*d*, and resistors R8, R9, R10 and R11 used to determine whether the signal input is within or beyond the range of a standard potential. If the signal input has a potential lower than the standard potential at the negative terminal of IC1*c*, then the output of IC1*c* is Low. If the signal input has a potential higher than the standard potential at the negative terminal of IC1*c*, then the output of IC1*c* is High. The change of potential at the output from IC1*d* is contrary to that of IC1*c*. Therefore, if the input potential is higher than either that of the negative terminal of IC1*c* or the positive terminal of IC1*d*, then the transistor TR1 is triggered and grounded.

(B) Sound Power Amplification and Driving

Whenever the output of the aforesaid amplitude limited comparator is beyond the standard potential and triggers the transistors TR1, and if TR1 is grounded, the potential of resistor R16 turns from High to Low, and pin "IN" of IC8 turns to Low too. If the clear terminal "C1" of IC-8 is High, then the pin "T2" of IC-8 is Low. Thus, capacitors C10 and C11 discharge through pin "T2", and the "Output" terminal of IC-8 simultaneously provides a High output through resistor R19 and diode D2 to the base of transistors TR3 so that TR3 is turned on and grounded. Thus, the negative potential via TR3 and resistor R53 to the base of PNP transistors TR4 is used to turn on TR4, and thus a positive potential goes to the voltage regulator IC5 and sound amplifier IC6 via TR4.

(C) Two Driving Modes

Function selector switches S1*a* and S1*b* are three-step switches. The upper step is for a normal function (visitor detection), the middle step is for turning off power, and the lower step is for an alert condition.

When the switch is at the upper step, i.e., the normal function condition, a negative potential is connected to the base of the PNP transistor TR8 via resistor 43 so that TR8 is switched on by a bias. Then, after stabilization by voltage regulator IC5, a positive current is passed through TR8, and then, after dividing by resistors R42 and R41, powers a music IC4 which hence gives a music signal output to variable resistor VR1 via diode D10 and resistor R40. The variable resistor VR1 is for volume adjustment. The music signal is then sent to a sound power amplifier IC6 for amplification to drive a speaker for providing audible music.

When the switch is at the lower step, i.e., the alert condition, the PNP transistor TR8 can't be switched on because there is no bias to its base, and thus the music IC4 will not function because of a lack of power. Since the base of NPN transistor TR7 is not grounded, a positive current after stabilization at voltage regulator IC5 is connecting to the base of TR7 via resistor R44, and TR7 is thus switched on by a bias, and then the positive current is connecting to a alarm generator circuit composed of IC3*a*, IC3*b* and IC3*d*.

(D) Alarm Generation

IC3*a* and resistors R21, R22, R23 and R24 as well as capacitor C15 compose a square wave generator. The square wave so generated charges capacitor C16 via resistor R25 and after rectification by a diode D8.

IC3*b*, resistors R26, R27, R28, R29, R30 and R31, and capacitor C17 compose an audible signal generator, and the frequency of the audible signal generated by it can be altered by a change of potential. Because the potential of C16 can be lowered by discharging via resistor R27, the audible signal from IC3*b* can have its frequency changed like the alarm provided by a police car. The signal is then sent to sound power amplifier IC6 via capacitor C19 and resistor R36 for amplification to drive the speaker for providing an alarm.

(E) Multiple Timing Setting and Time Priority Circuit

The present invention is mainly characterized by a multiple timing setting and time priority circuit. The time control circuit comprises timers including an analog/digital output type IC-7, a time display (LCD) and setting switches S2, S3 and S4 for time setting.

The first timer CH-1 is for timing control on an externally connected electrical appliance, the second timer CH-2 is for setting at any time to disarm the alert condition and for setting a time priority function to change the alarm signal to a music alarm, and the third timer is to disarm the alert condition at any time without setting the time priority function to prevent an improper alarm. With the third timer CH-3, a user can preset a time, such as the scheduled time of return, to disarm the alert condition.

When the second timer (CH-2) reaches the preset time of disarming alert condition, the output terminal of CH-2 provides a High signal to diodes D3, D4 and D6. The signal passing through D4 reaches the base of the NPN transistor TR2 via resistor R47 to switch on and ground TR2. Thus, the clear terminal "C1" of IC-8 is grounded so that IC-8 is cleared and provides no output; the detection function is hence inhibited.

The High signal passing through D3 goes to the base of the NPN transistor TR3 via resistor R52 to switch on and ground TR3. Then, the negative potential is connected to the base of the PNP transistor TR4 via TR3 and resistor R53 to switch on TR4; hence, a positive current is flowing to IC5 and IC6 via TR4.

The High signal passing through D6 goes to the base of the NPN transistor TR4 via resistor R45 to switch on and ground TR9 so that negative potential is connected to the base of the PNP transistor TR8 via TR9 and resistor R43 to switch on TR8. Then, the aforesaid positive current via TR4 and IC5 reaches resistor R42 and R39 via TR8. The positive current passing through resistor R42 reaches IC4 and causes IC4 to generate a music signal, which is then sent to IC6 for amplification and then to drive the speaker for providing music. The positive current passing through resistor R39 reaches the base of the NPN transistor TR5 to switch on and ground TR5, and thus the alarm output resistor R36 is grounded to prevent the generation of an alarm signal.

With the above design, in spite of the position of the function selector switches S1*a* and S1*b*, the generation of music is a priority and the alert function is disarmed if the output signal from CH-2 is high. Therefore, this timer can be used to control the signal detection system for disarming the alert function temporarily in order to easily allow the user to turn off the alarm at any time such as after waking up in morning.

When the third timer reaches the preset time for the disarming of the alert condition, the output terminal of CH-3 provides a High signal to diode D5 and then to the base of the NPN transistor TR2 via resistor R47 to switch on and ground TR2. Hence, the clear terminal "C1" of IC-8 is grounded; IC-8 is thus cleared and will not provide any output, such that the detection function is inhibited.

(F) Time-delay Circuit

The time-delay circuit is designed to continue generation of the sound/alarm for a certain period of time after the leaving of the detected person from the scope of detection even if he stays in the scope of detection for only a very short time. The sensor will not receive infrared after the detected person left the scope of the detection, and thus IC1*a* and IC1*b* do not provide signals, and the outputs from comparators IC1*c* and IC1*d* become low, and transistor TR1 becomes open because there is no bias to it, and a positive potential is connected to input pin "IN" of IC-8 via resistors R14 and R16 so that the potential at input pin "IN" turns from Low to High. If the clear terminal "C1" of IC-8 is High, then terminal "T2" of IC-8 turns from a discharging condition to a potential comparison condition. Since capacitors C10 and C11 have been discharged, their potential is lower than the standard potential in IC-8 so that the output terminal "OUT" of IC-8 remains High to switch on TR3 and TR4, and a positive current continues to flow to IC5 and IC6, and thus the generation of an audible signal continues.

Because resistor R15 charges C10 and C11, the potential of C10 and C11 becomes higher and higher. When the potential of C10 and C11 becomes higher than the standard potential in IC-8, the output terminal "OUT" of IC-8 turns from High to Low, and TR3 and TR4 becomes open, and the generation of the audible signal stops.

Therefore, a change of resistance of resistor R15 or a change of capacitance of capacitors C10 and C11 can change the delay-time. The time-delay circuit according to the present invention is characterized by two different lengths of delay time. Only C10 functions during a normal condition and thus the delay time is short because it is not necessary to generate an audible signal for a long time during a normal condition. During an alert condition, because the negative terminal of capacitor C11 is grounded by setting the switch S1*b* at the lower step, C11 and C10 are connected in parallel, and the capacitance is increased, and thus, the delay time is extended, and the alarm can continue for a long period of time.

In order to prevent an improper alarm, the volume of alarm can be divided into two stages. The length of the first stage can be set to 0–30 seconds at discretion, and the volume of the first stage can be set by a variable resistor VR2.

When the alarm circuit is powered via TR7, the capacitor C18 is charged by a positive current via R32. If the potential at the negative terminal of IC3*d* is lower than the standard potential at its positive terminal, the output of IC3*d* is High so that the potential is connected to the base of the NPN transistor TR6 via resistor R38 and after filtering by C20, TR6 is switched on by a bias and grounded; then, the negative terminal of the variable resistor VR2 is grounded, and the output potential of the alarm is lowered and thus volume of alarm is reduced.

The potential of C18 becomes higher and higher due to the charging, and the potential at the negative terminal IC3*d* gets higher and higher too. If the potential at the negative terminal of IC3*d* becomes higher than the standard potential at its positive terminal, the output of IC3*d* is low so that TR6 can't be switched on and grounded, at the volume of the alarm is thus not reduced but the output is provided at full volume. Therefore, the period for the first stage is adjustable by adjusting the variable resistor VR3 to change the standard potential at the positive terminal of IC3*d*.

The circuits and sensor in the present invention might be unstable during the initial period after connecting to a power source. Therefore, a delay circuit is designed to delay the starting of its function for about 2 minutes after connecting to a power source in order to prevent an improper detection and to permit the user to have a sufficient time to leave the scope of detection. The delay circuit is composed of the clear terminal "C1" of IC-8 and capacitor C13. Whenever the clear terminal "C1" of IC-8 is High, no clearing will occur. When the clear terminal "C1" of IC-8 is Low, IC-8 is cleared, and no output appears at output terminal "OUT" of IC-8, and the output terminal "OUT" is Low. The terminal "T2" charges capacitors C10 and C11 rapidly, and IC-8 is cleared and has no output. Before connected to the power source, the residual charge in capacitor C13 discharges through diode D1. As soon as the present invention is turned on, capacitor C13 is charged by a current via the voltage regulator IC2 and resistor R46. The potential of capacitor C13 is low during the initial period of charging, and the clear terminal "C1" of IC-8 maintains its Low and is still cleared. After charging for a certain period of time, capacitor C18 is fully charged, and the clear terminal "C1" of IC-8 turns to a High potential, and no clearing occurs, and the present invention is ready.

In addition to the aforesaid features and functions, the present invention has an "EXT" socket for connection of auxiliary device such as automatic dialing system, radio system, lighting system or other security facilities. Furthermore, the length of fire and burglar detection period can be set with its timers. It is indeed an economical, convenient and versatile fire and burglar alarm system.

I claim:

1. A timer controlled fire and burglar alarm system comprising:

a sensor means for detecting both living beings and fire within an area to be protected and for providing an output corresponding thereto;

a control circuit means operatively connected to said sensor means for providing control signals in response to said sensor output;

a music generator means and an alarm generator means both operatively connected to a sound amplifier means, said music generator means and alarm generator means both being controlled by control signals from said control means;

a switch means operatively connected to said control means for selectively switching said alarm system between a normal mode and an alert mode;

wherein when said system is in a normal mode, said music generator means is controlled by said control means so as to provide a music signal to said sound amplifier means for generating audible music;

and wherein when said system is in said alert mode, the detection of a living being or a fire by said sensor means causes said control means to control said alarm generator means so as to generate an alarm signal which is fed to said sound amplifier means so as to generate an audible alarm;

said timer control fire and burglar alarm system further comprising at least a first and a second timer means operatively connected to said control means;

wherein said first timer means causes said control means to not provide an alarm output from said sound amplifier means in the alert mode upon the detection of a living being or a fire by said sensor means when said system is in said alert mode but rather to control said music generator means so as to provide an output to said sound amplifier means to provide an audible music output, said first timer means operating after a predetermined period of time;

and wherein said second timer means controls said control means when said system is in said alert mode such that an audible alarm is not generated when said sensor means detects a living being or a fire;

said system further comprising a time delay means operatively connected to said control means and having a first time delay when said system is in said normal mode and having a second time delay which is longer than said first time delay when said system is in said alert mode;

wherein said time delay means controls said control means such that said audible alarm is generated for a period of time equal to said first or second time delay subsequent to a living being or a fire no longer being detected by said sensor means.

* * * * *